United States Patent [19]

Patterson

[11] 4,138,805

[45] Feb. 13, 1979

[54] WHEELED PORTABLE TRAILER SUBSTRUCTURE FOR ELEVATABLE DRAWWORKS, MASTS AND SETBACK TOWER

[75] Inventor: Bradley C. Patterson, Houston, Tex.

[73] Assignee: Pyramid Manufacturing Company, Houston, Tex.

[21] Appl. No.: 842,476

[22] Filed: Oct. 17, 1977

[51] Int. Cl.[2] ..... E04H 12/34

[52] U.S. Cl. ..... 52/118; 52/116

[58] Field of Search ..... 52/116, 118

[56] References Cited

U.S. PATENT DOCUMENTS

| | | | |
|---|---|---|---|
| 3,228,151 | 1/1966 | Woolslayer et al. | 52/116 X |
| 3,749,183 | 7/1973 | Branham et al. | 52/116 X |

FOREIGN PATENT DOCUMENTS

| | | | |
|---|---|---|---|
| 754392 | 8/1956 | United Kingdom | 52/116 |

*Primary Examiner*—Alfred C. Perham

*Attorney, Agent, or Firm*—Jack W. Hayden

[57] ABSTRACT

A first and second mobile trailer means are secured together for forming a base substructure support for a mast, setback tower and drawworks. A working floor is provided in elevated position above the base substructure support when the mast, setback tower and drawworks is in position to conduct well operations. The telescoping mast and setback structure is pivotally carried on the first trailer means and a drawworks is pivotally carried by the second trailer means. A power and rig up arrangement is provided to elevate in a desired sequence the mast, setback structure and drawworks to a desired position for securing on the base substructure support formed by the first and second trailer means for conducting well operations.

4 Claims, 12 Drawing Figures

WHEELED PORTABLE TRAILER SUBSTRUCTURE FOR ELEVATABLE DRAWWORKS, MASTS AND SETBACK TOWER

SUMMARY OF THE INVENTION

A trailer supported, telescoping, elevatable mast and drawworks arrangement has been provided and employed in the prior art; however, generally speaking such structures have necessitated the addition of a base support substructure before the mast and drawworks are properly positioned to conduct well drilling operations. The base support structure heretofore has been formed by adding a plurality of structural members at the drilling site to provide proper support for the trailers or between the trailers and the elevated mast and drawworks to structurally support the drawworks and mast load during well operations. Also, a drawworks, setback structure and mast have been employed to provide a working floor at a desired elevation above a base substructure constructed at the drilling site so that blowout preventers and other equipment may be positioned between the elevated working floor and the substructure and to enable other desirable operations in such arrangement to be conducted.

Also, in prior art arrangements, an A frame has been employed to assist in elevating the mast to final position.

The present invention provides a mobile trailer supported telescoping mast and setback structure as well as a trailer supported drawworks wherein the mobile trailers are constructed and arranged to form the base substructure support for the mast, setback tower and drawworks when in elevated position. This eliminates the necessity of building a separate substructure at the location and substantially shortens the rig up and rig down time required to enable the arrangement to be placed in operation for conducting well operations and to enable the arrangement to be removed from the well location after such operations have been conducted. The drawworks and mast are elevated in a desired sequence with the setback tower, thus eliminating the necessity of an A frame.

An object of the present invention is to provide a substructure to support an elevated drawworks, setback tower and mast structure which is formed by pinning or connecting together two portable wheeled trailers which rest directly on the ground and form the base substructure support for the drawworks, setback tower and mast.

An object of the present invention is to provide a substructure to support an elevated drawworks, setback tower and mast structure which is formed by pinning or connecting together two portable wheeled trailers which rest directly on the ground and form the base substructure support for the drawworks, setback tower and mast and wherein one trailer is provided with the telescoping mast and the setback tower and the other trailer is provided with the elevatable drawworks.

An object of the present invention is to provide a substructure to support an elevated drawworks, setback tower and mast structure which is formed by pinning or connecting together two portable wheeled trailers which rest directly on the ground and form the base substructure support for the drawworks, setback tower and mast and wherein one trailer is provided with the telescoping mast and the setback tower and the other trailer is provided with the elevatable drawworks and wherein the trailer supporting the telescoping mast assists in maintaining it in reclining position on the trailer until the mast is elevated.

An object of the present invention is to provide a substructure to support an elevated drawworks, setback tower and mast structure which is formed by pinning or connecting together two portable wheeled trailers which rest directly on the ground and form the base substructure support for the drawworks, setback tower and mast, and an arrangement whereby the mast may be elevated without the use of an A frame.

An object of the present invention is to provide a substructure to support an elevated drawworks, setback tower and mast structure which is formed by pinning or connecting together two portable wheeled trailers which rest directly on the ground and form the base substructure support for the drawworks, setback tower and mast, and an arrangement whereby the mast is elevated with the drawworks and setback tower.

An object of the present invention is to provide a substructure to support an elevated drawworks, setback tower and mast structure which is formed by pinning or connecting together two portable wheeled trailers which rest directly on the ground and form the base substructure support for the drawworks, setback tower and mast, and an arrangement whereby the mast is elevated with the drawworks and setback tower and with the drawworks in either an elevated or non-elevated position in relation to the trailers.

Other objects and advantages of the present invention will become more readily apparent from a consideration of the following description and drawings.

BRIEF DESCRIPTION OF THE DRAWINGS

FIG. 9 is a view on the line 9—9 of FIG. 7A illustrating the elevated working floor area formed by the setback structure, mast and drawworks;

DESCRIPTION OF THE PREFERRED EMBODIMENT

Figure 1:
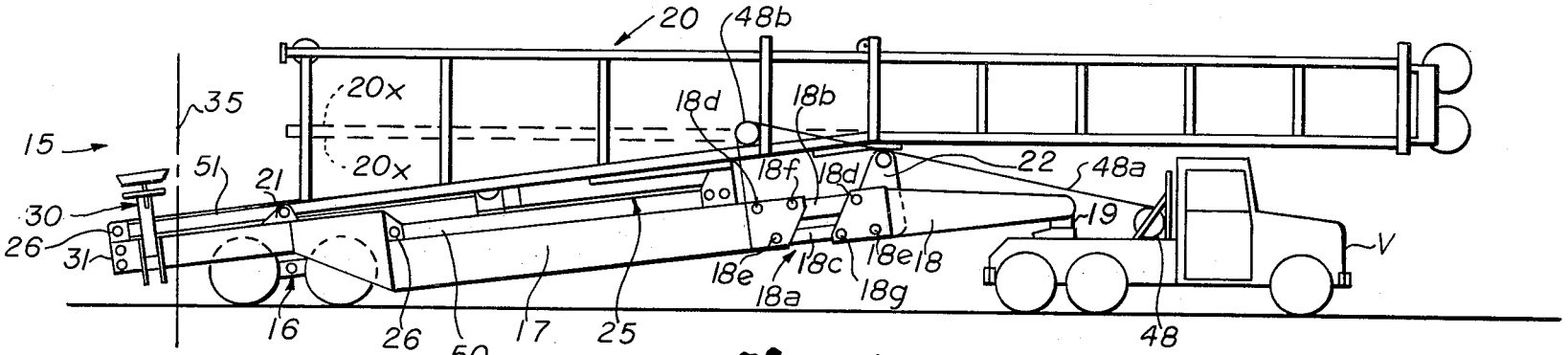
FIG. 1 is a view showing one of the portable wheeled trailer means with a mast pivotally supported thereby and astride a setback structure pivotally mounted on the trailer.

Attention is first directed to FIG. 1 of the drawings wherein the first trailer means is represented generally by the numeral 15. The trailer 15 includes a suitable wheeled carriage 16 formed by longitudinally and laterally spaced wheels which carries longitudinally extending, laterally spaced members one of which is illustrated at 17. The longitudinally extending members 17 are connected together and spaced apart by laterally extending braces, not shown. A mast referred to generally at 20 is pivotally mounted at 21 at its lower end and rests on the member 22 extending upwardly from the extension 18 of the longitudinally extending members 17.

Figure 2:
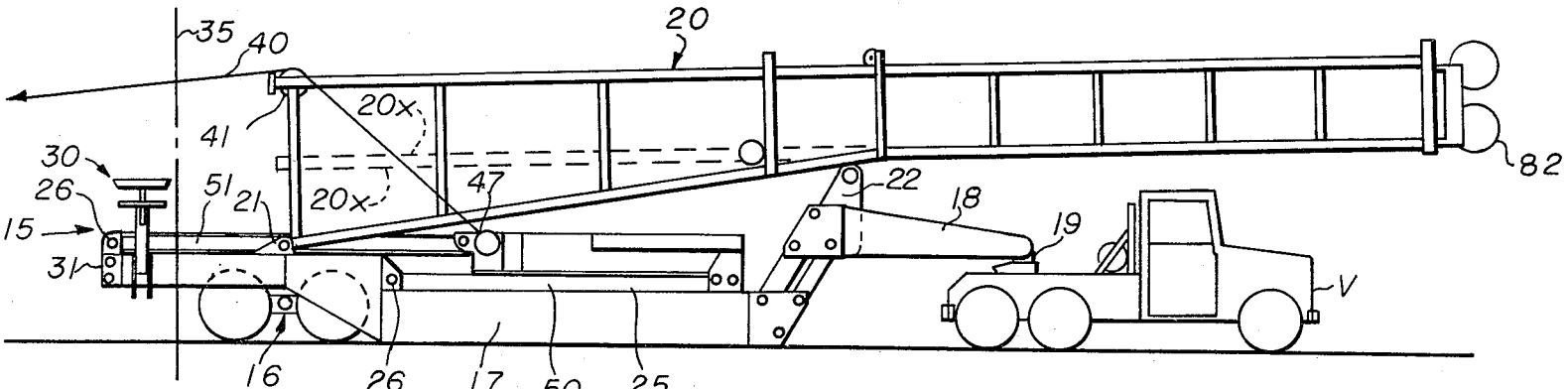
FIG. 2 is a view similar to FIG. 1 but showing a portion of the trailer resting on the ground surface to form part of the base structure.

A pipe setback and support structure referred to generally at 25 is pivotally supported at 26 on the trailer 15, and the mast 20 is wide enough so that it is astride the setback structure 25 as will be described in greater detail hereinafter. Lateral brace means 30 are provided on each side of the trailer 15 and are pivotally secured to such trailer 15 so that during transport of the mast 20 and the setback tower 25 while resting on the trailer 15, the lateral brace means 30 also rests on the longitudinally extending members 17 for clearance of the trailer 15 along roadways and the like. This position and relationship is illustrated in FIGS. 1 and 2 of the drawings.

A vehicle represented by the letter V may be employed to transport the first trailer means 15 with the reclining mast 20 and setback structure 25 thereon as illustrated in FIG. 1. It will be noted that the portion 18 of the longitudinal members 17 extends to a fifth wheel 19 on the truck so that the trailer 15 as well as the reclining mast 20 and the reclining setback tower 25 are freely pivotal relative to the vehicle V to enable the trailer 15 and truck V to be manuevered on a road along which it may move.

In FIG. 1 there is illustrated at 35 the center line of a well relative to which the mast 20, setback structure 25 and drawworks 70 of the present invention are to be positioned, and as seen in FIG. 1, the trailer 15 has been manuevered by the vehicle V into position in a manner well known in the art so that when the components of the present invention are positioned, they will be in proper relationship relative to the center line 35 of the well or location where well operations are to be conducted.

It will be noted that the extension 18 of the longitudinal members 17 are connected together by the arrangement referred to generally at 18*a*. The arrangement 18*a* includes a pair of spaced members 18*b* and 18*c* which are pivotally connected at their ends 18*d*, and 18*e* to the laterally spaced, longitudinal members 17 of the first trailer 15 and to the longitudinal extensions 18 as shown in the drawings. Locking pins 18*f* and 18*g* may be removed from the members 18*b* and 18*c* whereupon the members 17 of the trailer 15 are lowered to rest on the ground by the cable 48*a* connected thereto and extending over pulley 48*b* on mast 20 to the winch 48 or vehicle V as illustrated in FIG. 2. Since the portion 18 is still connected to the fifth wheel 19 of the vehicle V, the support 22 retains its position that it had in FIG. 1 of the drawings to maintain the telescoping mast 20 in substantially the same relative position to the trailer 15 and the vehicle V. When the members 17 are lowered to the ground and before the vehicle is disconnected, as shown in FIG. 2, it will be noted that the mast 20 is elevated by 22 as the members 17 are lowered to ground level.

Figure 3:
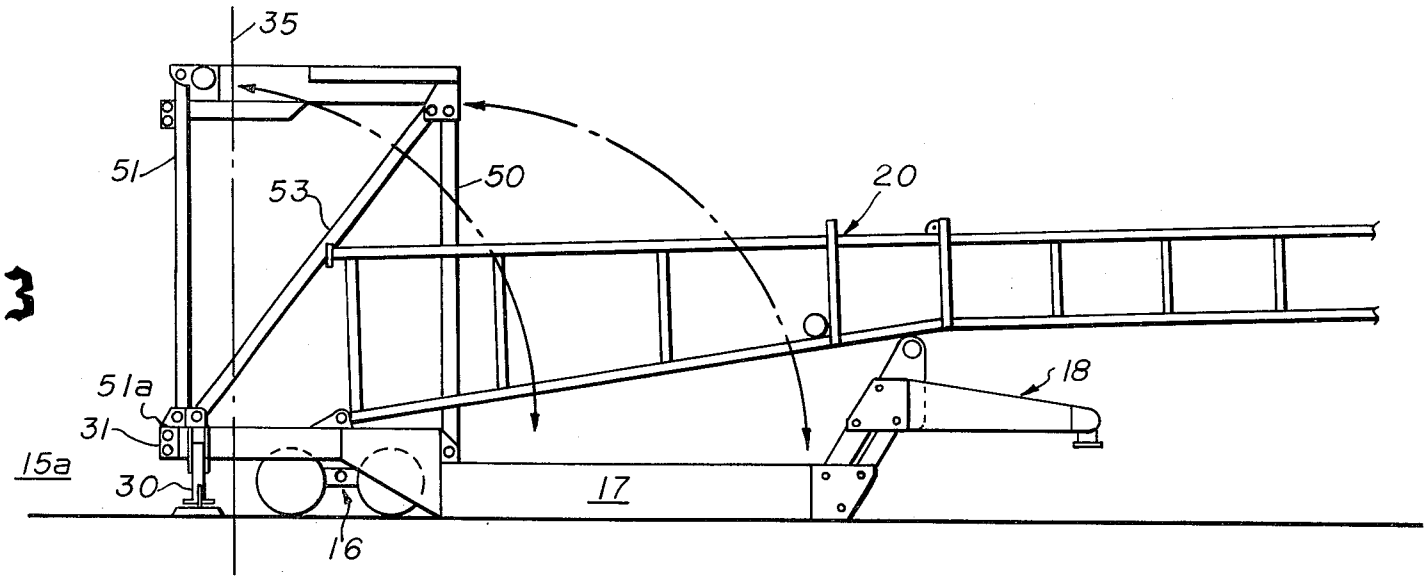
FIG. 3 illustrates the position of the setback structure or tower when it has been pivoted to an upright position.
Figure 5:
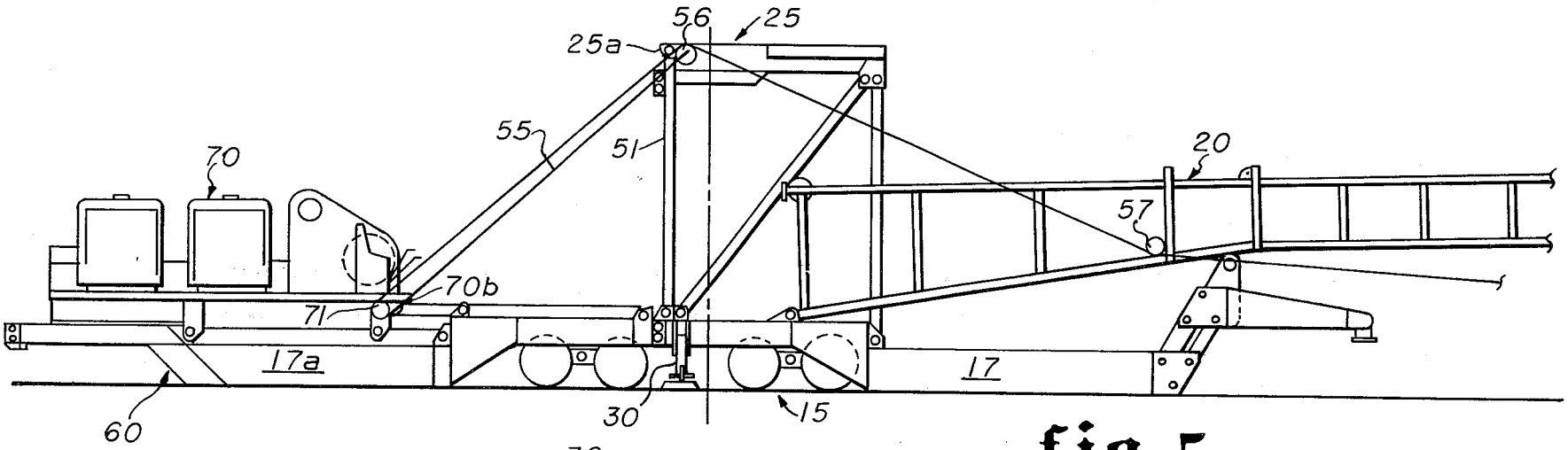
FIG. 5 shows the first and second trailer means secured together and the drawworks connected for elevating it to its final position.
Figure 8:
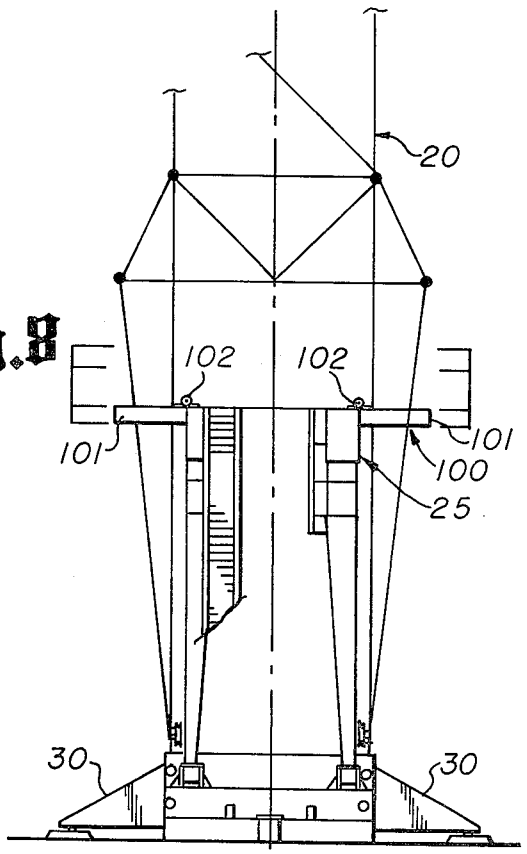
FIG. 8 is an end view looking towards the base substructure illustrating the lateral brace means pivotally supported on the trailers to assist in maintaining the base substructure in position as well operations are conducted.
Figure 6:
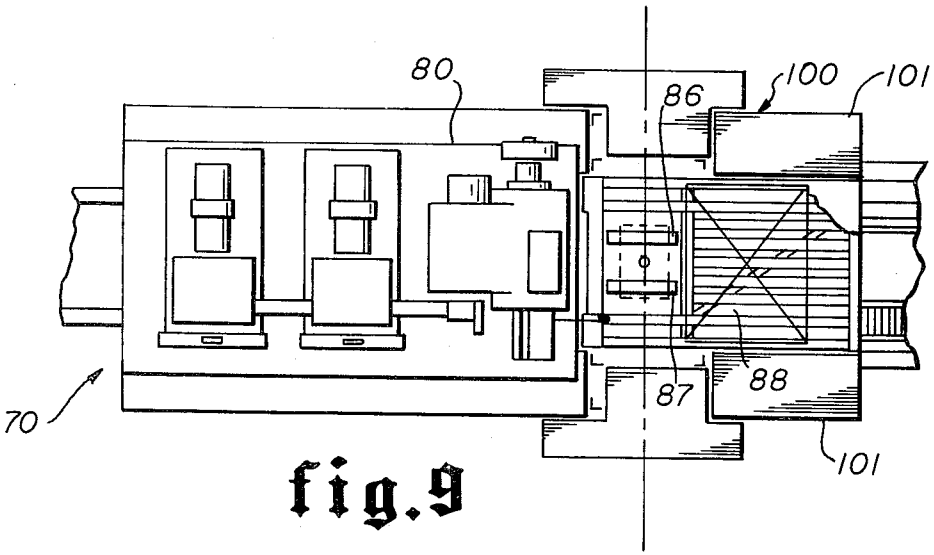

After the members 17 have been lowered to the ground as shown in FIG. 2 and before the setback tower 25 is elevated the lateral brace member 30 is pivoted outwardly and downwardly to rest on the ground as shown in FIGS. 3, 5 and 8 of the drawings. Any suitable number of lateral braces may be employed longitudinally of the trailer 15, and as illustrated one brace member 30 is provided on each side adjacent an end of the trailer 15.

The mast 20 generally incorporates at least two telescoping sections represented in dotted line at 20*x* within the portion shown in solid line in FIGS. 1 and 2 of the drawings. These portions 20*x* are extended from the solid line portion by a winch line or by the other means as well known in the art.

Figure 4:
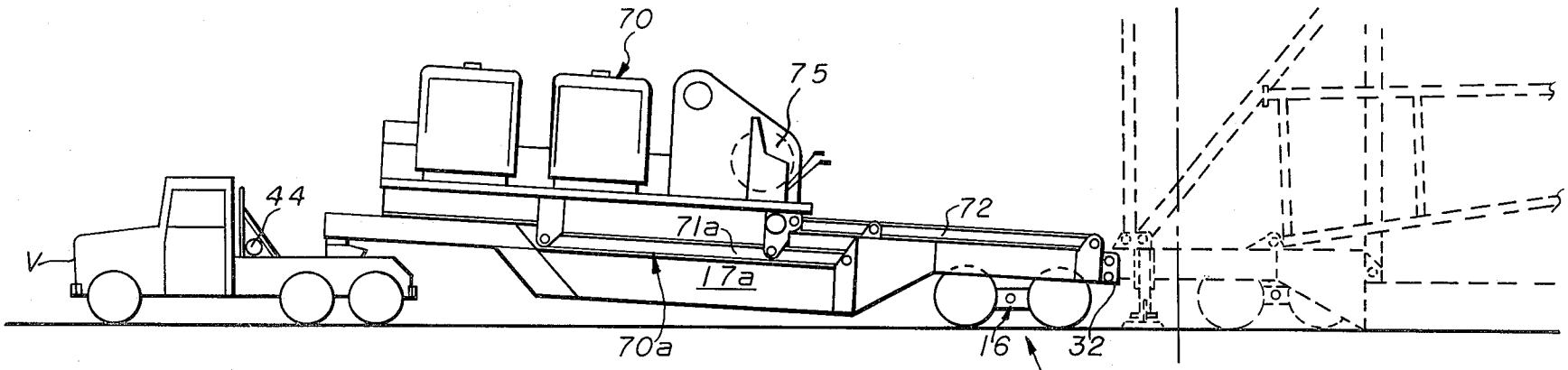
FIG. 4 illustrates a second trailer means with a drawworks pivotally supported thereon moved into position adjacent the first drawworks.

The setback tower 25 may then be moved to elevated position by connecting separate lines 40 over sheaves 41 spaced laterally on the mast 20 and securing one end of each line as at 47 to each side of the setback structure 25 resting on trailer 15 as shown in FIG. 2. The other end of the lines 40 may be connected to a winch 44 on any suitable vehicle such as represented at V′ in FIG. 4 whereupon the setback structure 25 may be elevated by pulling on the lines or cables 40 to pivotally raise the setback tower 25 so that it assumes the position illustrated in FIG. 3 of the drawings. It will be noted that the setback structure 25 includes four legs two of which are illustrated at 50 and 51 on one side of trailer 15 with two other similar legs being provided on the other side of the trailer 15 so that the setback structure 25 generally forms a rectangular box like structure when elevated as seen in FIG. 3. A lateral brace 53 is secured diagonally between the legs 50 and 51 on each side of the setback tower 25 as shown in FIG. 3 and the legs 51 are secured in the footings 51*a* formed on the trailer 15 to secure the setback tower 25 in the elevated position shown in FIG. 3 of the drawings.

When it is desired to disconnect trailer 15 from vehicle V and move the vehicle V from beneath the mast 20, locking pins 18*f* and 18*g* are reinserted in openings 18*b* and 18*c* to thereby retain the extension 18 in the position shown in FIGS. 3 and 5. If the extension 18 is lowered to ground level by removing the locking pins, a support of any suitable construction as represented by the letter S in FIG. 6 may be positioned under the mast 20 to retain it in position until it is elevated.

The second trailer 60 is moved into position by a vehicle V′ connected therewith and again the second trailer 60 includes a wheeled carriage 16 for transport or movement of the trailer and drawworks pivotally supported thereon. The second trailer 60 includes longitudinally extending, laterally spaced beams 17*a* which are connected together by suitable lateral members (not shown) to form a base substructure support for the drawworks represented generally by the numeral 70 in FIG. 4.

The first trailer 15 and the second trailer 60 each include suitable bracket and brace means 31 and 32 having openings therein as shown so that when the first and second trailers are positioned as illustrated in FIGS. 4 thru 7A of the drawings, the braces interfit so they may be pinned or secured together to form an integral base substructure support. After the second trailer means 60 has been positioned adjacent the end of the first trailer means 15, the vehicle V' supporting the second trailer 60 may be driven out from beneath the second trailer 60 and the members 17a of the second trailer lowered to the ground by a winch and cable (not shown).

Thus, the first trailer 15 and second trailer 60 are not only secured together but their bodies form the base substructure to support the mast, setback tower and drawworks in elevated position as well operations are conducted as will be described in greater detail hereinafter. It is to be noted that substantially no additional substructure or supports are provided between the elevated floor referred to generally at 80 in FIG. 9 and the base support structure formed by the longitudinally extending members 17, 18, and 17a of the trailer means 15 and 60. After the first trailer means 15 and second trailer means 60 have been secured together at their abutting ends as shown in FIG. 5 by any suitable means securing the brackets and braces 31 and 32, the drawworks referred to generally at 70 and the mast referred to generally at 20 may be elevated into working position.

The drawworks 70 is carried on a support 70a pivotally mounted on the trailer 60. The elevatable drawworks support 70a includes four legs. Legs 71a and 72 are pivotally connected on one side of trailer 60 and similar legs are pivotally connected on the other side of trailer 60. In the sequence illustrated in FIG. 5, lines 55 are connected to each side of the elevated setback tower 25 adjacent the legs 51 nearest the reclining drawworks 70. The cables 55 are each extended over a sheave 71 adjacent each side of the reclining drawworks support 70a and then reeved over a sheave 56 mounted adjacent the upper end of the elevated setback tower 25 and extended beneath the sheaves 57 in each side of the reclining mast 20 and are then connected to a winch 48 on the vehicle V of FIG. 1, or any other suitable winch on a vehicle. By pulling on the cables 55 by means of the winch 48 on the vehicle, the drawworks support 70a and drawworks 70 is then elevated to the position shown in FIG. 6 on the trailer 60.

Figure 6:
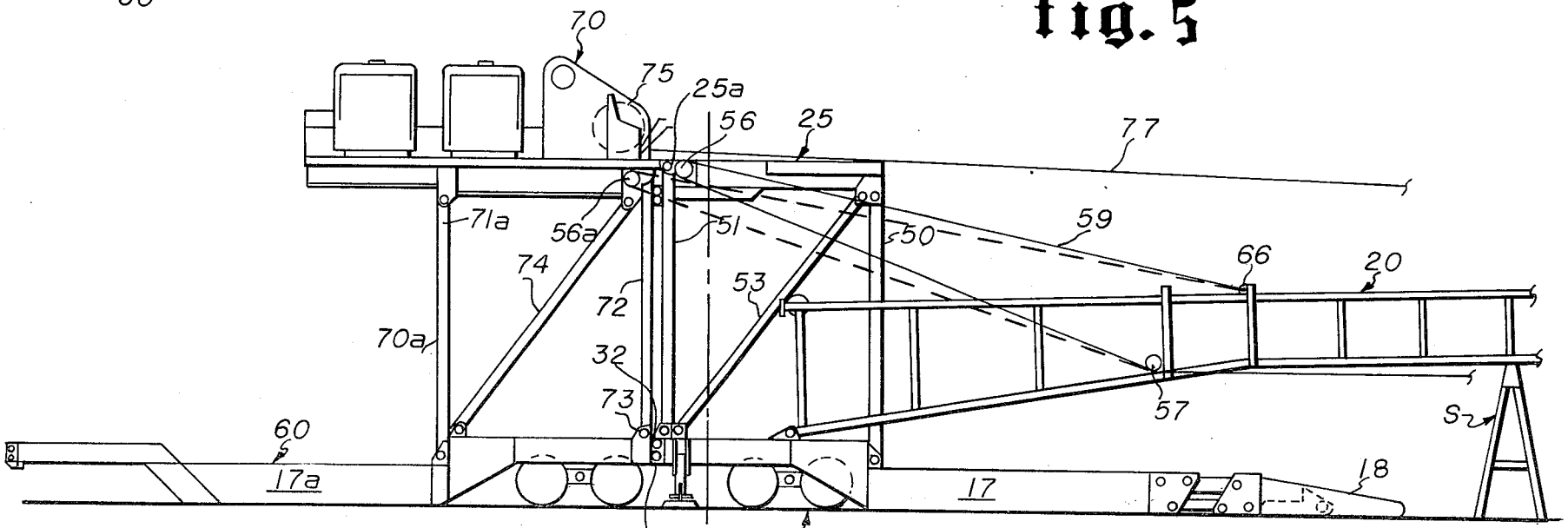
FIG. 6 is a view showing one sequence of elevating the drawworks and mast with the drawworks elevated to its final position and secured with the setback structure and the mast connected for elevating it to its fixed position.

After the drawworks support 70a has been elevated to the position as shown in FIG. 6, it is secured to the trailer 60 by the legs 72 being pinned to the footing 73. Also a lateral brace 74 is then positioned in an inclined relationship between the legs 71a and 72 on each side of the support 70a and between the upper end of the support 70a and the base substructure formed by the members 17 on the second trailer 60.

Also, the drawworks support structure 70a may be secured to the setback structure 25 by the brackets 25a at the upper end of the setback tower 25 and the brackets 70b at the upper end of the elevated drawworks support 70a which brackets may be secured together by any type of linkage or pin member. Thus, the drawworks support 70a and setback tower 25 form a unitary structure when elevated and secured together as well as having their lower ends rigidly secured on their respective trailers 15 and 60.

Figure 7:
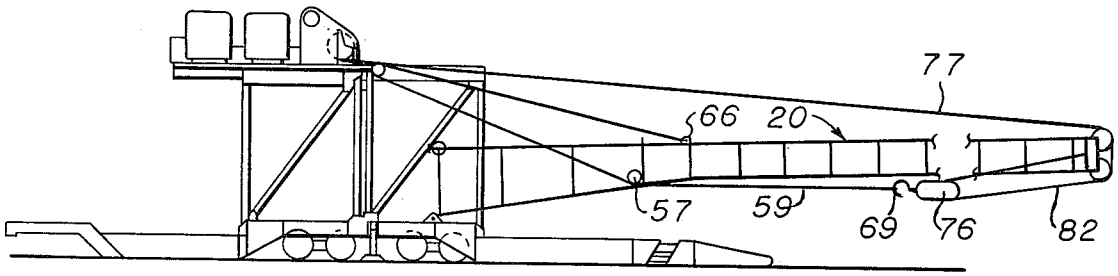
FIG. 7 is a view illustrating the sling and rig up arrangement for elevating the mast with the drawworks and set back tower and more particularly shows the relationship of the various components for raising or elevating the mast after the drawworks has been elevated.
Figure 7A:
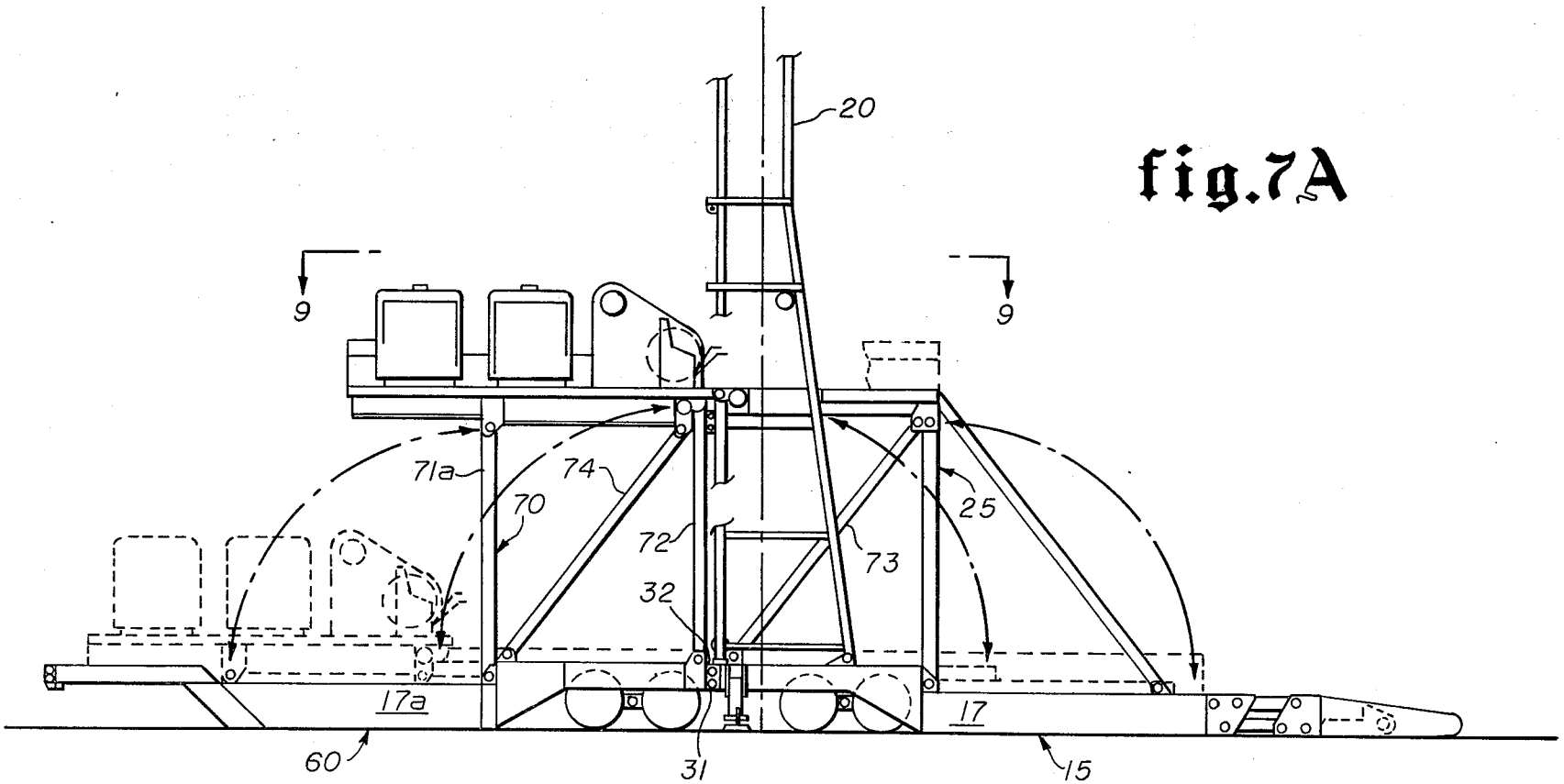
FIG. 7A shows the mast, drawworks and setback tower in elevated position on the trailers which are secured together to form the base substructure for the mast, drawworks and setback tower.

When this sequence of elevation is employed, the mast 20 may next be elevated by connecting line 59 at any suitable point such as the points 66 on each the reclining mast 20 and then extending such lines over the sheaves 56 on each side of the elevated setback tower 25. The lines 59 then extend under the sheaves 57 on each side of mast 20 and the lines 59 are then connected to the hook 69 on the traveling block 76 in the mast 20 as illustrated in FIG. 7 of the drawings. The line 59 in effect forms a sling. A line 77 is then extended from the drawworks drum illustrated at 75 and over the crown block 82 on the mast 20 to be connected in a manner well known to the traveling block 76. Thus when the cable 77 is reeved in on the drum 75 of the drawworks, the traveling block moves in the mast 20 and cable 59 is pulled so that the mast 20 is moved to elevated position as illustrated in FIG. 7A of the drawings. If desired, the line 59 may be reeved around sheave 56a on the drawworks support structure 70a to elevate the mast 20.

As previously noted, the four legs of the mast 20 are laterally spaced far apart enough so as to straddle the setback tower 25 when the mast and the setback tower are in lowered position on the first trailer 15 and thus when the mast 20 is moved to its elevated position as shown in the drawings, the elevated setback tower 25 will not interfere with such movement. After the mast 20 has been moved to an upright position it also may be secured to the base substructure formed by the first and second trailer means 15 and 60 respectively by securing the lower end of the mast legs to the beams 17 and 17a in any suitable manner as desired.

Figure 10:
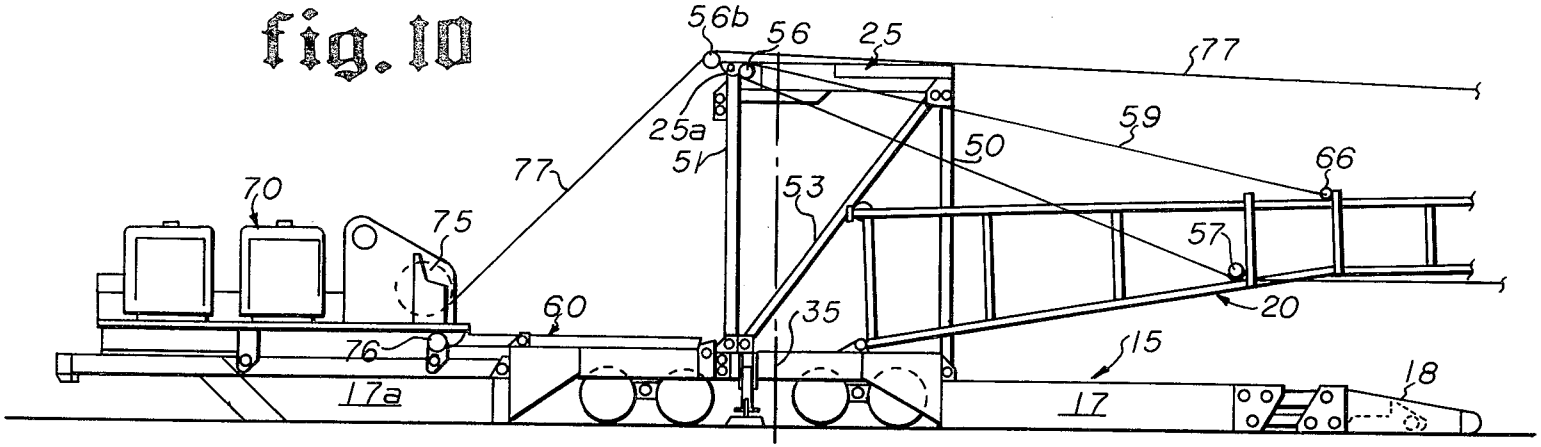
FIG. 10 is a view illustrating the arrangement for raising the mast with the drawworks in the down position.
Figure 11:
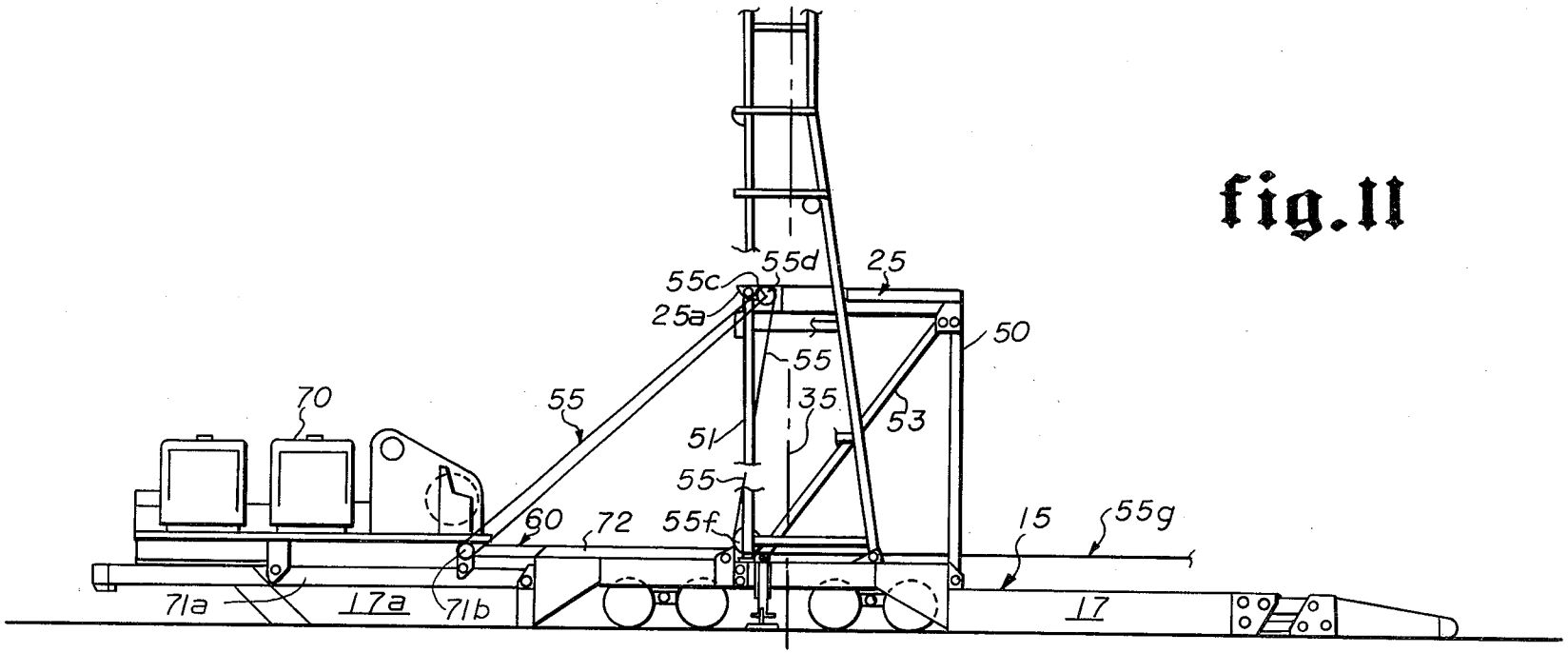
FIG. 11 is a view illustrating the arrangement for raising the drawworks after the mast has been elevated.

If desired, the sequence of elevation illustrated in FIGS. 10 and 11 may be employed. If so, the setback tower 25 is first elevated as shown and as previously described. The mast 20 is next elevated by connecting the sling line 59 from points 66 on the mast 20 and extending around sheaves 56 on the raised setback tower 25, under sheave 57 on mast 20 and connecting each line 59 with the hook 69 on the travelling block. The line 77 wound on drum 75 of drawworks 70 is reeved over sheave 56b and extends over the crown block as shown in FIG. 7 for connection with the traveling block 76. When the cable 77 is reeved in on drum 75, mast 20 is raised to the position of FIG. 11 for connection with the trailer 15 as previously described.

The drawworks 70 and its support structure 70a is elevated on trailer 60 by connecting lines 55 as at 55c to each side of setback tower 25. The lines 55 are then reeved around sheaves 71b on drawworks support structure 70a and then over sheaves 55d on each side of the setback tower 25, and then under sheave 55f on the lower end of the setback tower 25 to be connected to winches (not shown) as illustrated at 55g. When the lines 55 are reeved in on the winches, the drawworks 70 and its support structure 70 are elevated to the position illustrated in FIG. 6. It is then connected to the setback tower and trailer 60 as previously described to secure it in position.

The drawworks support 70a, the mast 20 and the setback tower 25 can each be provided with suitable grill or floor plate material as illustrated generally at 100 in FIG. 9 to form a work area referred to generally at 80 which is elevated relative to the base substructure formed by the structure of the first and second trailer means 15 and 60. It is to be also noted that the mast 20 includes suitable rotary table support members 86 and 87 as illustrated in FIG. 9 of the drawings. If desired the setback structure 25 may have a slotted portion illustrated at 88 formed in its floor 100 to enable tubular members to be positioned vertically therein as they are removed from the well, or to enable tubular members to be positioned vertically in the setback tower 25 and connected into the well string as may be desired.

It is to be also noted that the floor structure 100 carried by the setback tower 25 includes laterally extending portions 101 as more clearly illustrated in FIG. 8 of the drawings. The laterally extending portions 101 are pivotally secured at 102 adjacent the outer edges of the setback tower 25 as shown so that such floor portions 101 can be moved into operating position after the setback tower 25 has been raised to an elevated position. Of course when the setback tower 25 is reclining on the trailer 15, the floor portions 101 are pivoted over and onto the reclining setback tower 25 in a manner so as to not interfere with movement of the trailer 15 along a road or highway.

The foregoing arrangement provides a mobile trailer support structure for a portable telescoping mast, drawworks, and setback tower which can be moved from location to location with ease.

The trailers can be positioned on a well location, and secured together. Their frames are lowered to the ground to form the base substructure for the mast, setback tower and drawworks when they are elevated to working position for conducting well operations.

The foregoing disclosure and description of the invention are illustrative and explanatory thereof, and various changes in the size, shape, and materials as well as in the details of the illustrated construction may be made without departing from the spirit of the invention.

What is claimed is:

1. In a portable well drilling and workover apparatus including a mast, drawworks and setback structure which may be raised to provide an elevated working floor for conducting well operations the invention comprising:

a. first trailer means;

b. second trailer means;

c. means for positioning said first and second trailer means together to form a base substructure support for the apparatus;

d. means pivotally connecting the mast and setback structure on said first trailer means whereby they may be transported in reclined position and then elevated when desired;

e. support means pivotally supporting said drawworks on said second trailer means;

f. sheave means on said mast for receiving a line thereover secured at one end to said setback structure resting on said first trailer means and connected with power means at its other end to first elevate said setback structure; and g. means to secure said setback structure in elevated position on said first trailer means.

2. The invention of claim 1 including:

a. sheave means on said setback structure and said drawworks platform whereby a line may be secured to said setback structure and extended around said sheave on said drawworks platform and around said sheave means on said setback structure and connected to a power source for elevating said drawworks and said support therefor; and b. means to secure said drawworks support means in elevated position on said second trailer means.

3. The invention of claim 2 including:

a. a traveling block in said mast and having a line extending therefrom, over the crown block and connected to said drawworks;

b. a sling connected at one end to the resting mast on said first trailer means, extended over a sheave on said elevated setback structure and connected at its other end to said traveling block whereby said elevated drawworks may be employed to elevate said mast up over said setback structure; and c. means to secure said mast in elevated position on said first trailer means.

4. The invention of claim 3 including laterally extending brace means pivotally carried by at least one of said trailer means for providing additional stability to the base substructure.

* * * * *